US009157137B2

(12) United States Patent
Nakamura et al.

(10) Patent No.: US 9,157,137 B2
(45) Date of Patent: Oct. 13, 2015

(54) FERRITIC STAINLESS STEEL EXCELLENT IN OXIDATION RESISTANCE

(75) Inventors: Tetsuyuki Nakamura, Chiba (JP); Hiroki Ota, Chiba (JP); Takumi Ujiro, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 13/884,995

(22) PCT Filed: Oct. 12, 2011

(86) PCT No.: PCT/JP2011/073981

§ 371 (c)(1), (2), (4) Date: Jun. 18, 2013

(87) PCT Pub. No.: WO2012/063613

PCT Pub. Date: May 18, 2012

(65) Prior Publication Data

US 2013/0272912 A1 Oct. 17, 2013

(30) Foreign Application Priority Data

Nov. 11, 2010 (JP) ..... 2010-252772

(51) Int. Cl.
*C22C 38/26* (2006.01)
*C22C 38/32* (2006.01)
(Continued)

(52) U.S. Cl.
CPC ..... *C22C 38/32* (2013.01); *C21D 6/002* (2013.01); *C21D 8/0226* (2013.01);
(Continued)

(58) Field of Classification Search
CPC ..... C22C 38/00; C22C 38/02; C22C 38/04; C22C 38/06; C22C 38/18; C22C 38/26; C22C 38/40; C22C 38/48
USPC ..... 148/320, 325; 420/8, 34, 62, 103
See application file for complete search history.

(56) References Cited

U.S. PATENT DOCUMENTS 5,372,778 A * 12/1994 Yahagi et al. ..... 420/41
6,911,098 B2 * 6/2005 Yazawa et al. ..... 148/325
(Continued)

FOREIGN PATENT DOCUMENTS

JP A-2000-297355 10/2000
JP A-2004-018921 1/2004
(Continued)

OTHER PUBLICATIONS

International Search Report issued in Application No. PCT/JP2011/073981; Dated Jan. 24, 2012 (With Translation).

*Primary Examiner* — Scott Kastler
*Assistant Examiner* — Vanessa Luk
(74) *Attorney, Agent, or Firm* — Oliff PLC

(57) ABSTRACT

An object is to provide a ferritic stainless steel having excellent oxidation resistance, while preventing a deterioration in formability, without adding expensive chemical elements such as Mo and W. Specifically, the ferritic stainless steel excellent in oxidation resistance having a chemical composition containing, by mass %, C: 0.015% or less, Si: 0.40% or more and 1.00% or less, Mn: 1.00% or less, P: 0.040% or less, S: 0.010% or less, Cr: 12.0% or more and 23.0% or less, N: 0.015% or less, Nb: 0.30% or more and 0.65% or less, Ti: 0.150% or less, Mo: 0.10% or less, W: 0.10% or less, Cu: less than 1.00%, Al: 0.20% or more and 1.00% or less, while the relationship Si≥Al is satisfied, and the balance being Fe and inevitable impurities.

6 Claims, 1 Drawing Sheet

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/30*** | (2006.01) |
| ***C22C 38/20*** | (2006.01) |
| ***C22C 38/24*** | (2006.01) |
| ***C22C 1/02*** | (2006.01) |

(52) U.S. Cl.

CPC ..... *C21D 8/0236* (2013.01); *C21D 8/0273* (2013.01); *C22C 1/02* (2013.01); *C22C 38/001* (2013.01); *C22C 38/004* (2013.01); *C22C 38/005* (2013.01); *C22C 38/02* (2013.01); *C22C 38/04* (2013.01); *C22C 38/06* (2013.01); *C22C 38/20* (2013.01); *C22C 38/24* (2013.01); *C22C 38/26* (2013.01); *C22C 38/28* (2013.01); *C22C 38/30* (2013.01)

(56) References Cited

U.S. PATENT DOCUMENTS

| | | | | |
|---|---|---|---|---|
| 2010/0218856 | A1 | 9/2010 | Hamada et al. | |
| 2010/0272594 | A1 * | 10/2010 | Hiraide ..... | 420/41 |
| 2011/0008200 | A1 | 1/2011 | Kato et al. | |

FOREIGN PATENT DOCUMENTS

| | | | | |
|---|---|---|---|---|
| JP | A-2006-117985 | | 5/2006 | |
| WO | WO 03/004714 | A1 | 1/2003 | |
| WO | WO 2008/004506 | A1 | 1/2008 | |
| WO | WO2009/084526 | A1 * | 7/2009 | ..... C22C 38/58 |
| WO | WO 2009/110640 | A1 | 9/2009 | |

* cited by examiner

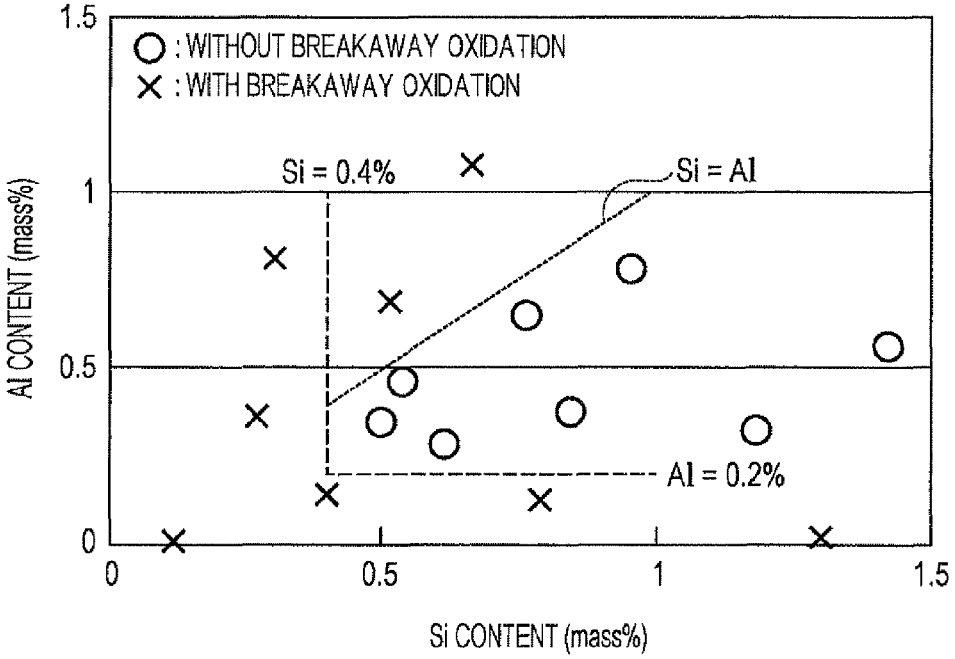
1.5
1
0.5
0
0
0.5
1
1.5
○ : WITHOUT BREAKAWAY OXIDATION
× : WITH BREAKAWAY OXIDATION
Si = 0.4%
Si = Al
Al = 0.2%
Al CONTENT (mass%)
Si CONTENT (mass%)

FERRITIC STAINLESS STEEL EXCELLENT IN OXIDATION RESISTANCE

TECHNICAL FIELD

The present invention relates to a ferritic stainless steel having excellent oxidation resistance which can be ideally used for the parts of an exhaust system which are used in a high temperature environment. The parts are such as an exhaust pipe and a catalyst outer cylinder (also called a converter case) of an automobile and a motorcycle, and an exhaust air duct of a thermal electric power plant.

BACKGROUND ART

The parts of an exhaust system such as an exhaust manifold, an exhaust pipe, a converter case and a muffler are used in the environment of the exhaust system of an automobile. The parts are required to be excellent in a thermal fatigue property, a high-temperature fatigue property and oxidation resistance (hereinafter, these properties are collectively called a heat resistance). For applications in which the heat resistance is required as described above, nowadays, Cr containing steel to which Nb and Si are added such as Type429 (14Cr-0.9Si-0.4Nb) is often used. However, since an exhaust gas temperature has become higher than 900° C. in association with the improvement of engine performance, the thermal fatigue property of Type429 has become unsatisfactory.

In order to solve this problem, Cr containing steel having a high-temperature yield strength increased by adding Nb and Mo, SUS444 (19Cr-0.5Nb-2Mo) conforming to JIS G 4305 and a ferritic stainless steel containing less Cr to which Nb, Mo and W are added and the like have been developed (refer to, for example, Patent Literature 1). However, since the prices of rare metals such as Mo and W have been markedly rising recently, the development of a material having a heat resistance equivalent to these kinds of steel by using inexpensive raw materials has become to be required.

Examples of materials having an excellent heat resistance without using expensive chemical elements such as Mo and W are disclosed by Patent Literatures 2 through 4. Patent Literature 2 discloses a ferritic stainless steel to be used for the parts of an exhaust gas flow channel of an automobile in which Nb: 0.50 mass % or less, Cu: 0.8 mass % or more and 2.0 mass % or less and V: 0.03 mass % or more and 0.20 mass % or less are added to a steel having a Cr content of 10 mass % or more and 20 mass % or less. Patent Literature 3 discloses a ferritic stainless steel excellent in a thermal fatigue property in which Ti: 0.05 mass % or more and 0.30 mass % or less, Nb: 0.10 mass % or more and 0.60 mass % or less, Cu: 0.8 mass % or more and 2.0 mass % or less and B: 0.0005 mass % or more and 0.02 mass % or less are added to a steel having a Cr content of 10 mass % or more and 20 mass % or less. Patent Literature 4 discloses a ferritic stainless steel to be used for the parts of an exhaust gas flow channel of an automobile in which Cu: 1 mass % or more and 3 mass % or less is added to a steel having a Cr content of 15 mass % or more and 25 mass % or less. These kinds of disclosed steel are characterized by having a thermal fatigue property improved by adding Cu.

CITATION LIST

Patent Literature

[PTL 1] Japanese Unexamined Patent Application Publication No. 2004-018921

[PTL 2] International Publication No. WO2003/004714

[PTL 3] Japanese Unexamined Patent Application Publication No. 2006-117985

[PTL 4] Japanese Unexamined Patent Application Publication No. 2000-297355

SUMMARY OF INVENTION

Technical Problem

However, according to investigations carried out by the present inventors, in the case where Cu is added as in the methods disclosed by Patent Literatures 2 through 4, it has been found that, formability and oxidation resistance are significantly deteriorated.

The present invention has been completed in view of the situation described above, and an object of the present invention is to provide a ferritic stainless steel having excellent oxidation resistance, while preventing a deterioration in formability, without adding expensive chemical elements such as Mo and W.

The meaning of "having excellent oxidation resistance" according to the present invention is that breakaway oxidation does not occur (a weight gain by oxidation is 50 ($g/m^2$) or less) even if the steel is held in an atmospheric ambience at a temperature of 1000° C. for a duration of 200 hours.

Solution to Problem

The present inventors diligently conducted investigations in order to develop a ferritic stainless steel excellent in oxidation resistance, while preventing a deterioration in formability, without adding expensive chemical elements such as Mo or W. As a result, inventors found that excellent oxidation resistance at a temperature of 1000° C. (hereinafter, called 1000° C. oxidation resistance) can be achieved by setting Cu content to be 1.0 mass % or less, and, in addition, by setting Si content to be 0.4 mass % or more and 1.0 mass % or less and Al content to be 0.2 mass % or more and 1.0 mass % or less while the relationship Si≥Al is satisfied, which led to the completion of the present invention.

That is to say, the present invention provides a ferritic stainless steel excellent in oxidation resistance having a chemical composition containing, by mass %, C: 0.015% or less, Si: 0.40% or more and 1.00% or less, Mn: 1.00% or less, P: 0.040% or less, S: 0.010% or less, Cr: 12.0% or more and 23.0% or less, N: 0.015% or less, Nb: 0.3% or more and 0.65% or less, Ti: 0.150% or less, Mo: 0.10% or less, W: 0.10% or less, Cu: less than 1.00%, Al: 0.20% or more and 1.00% or less, while the relationship Si≥Al is satisfied, and the balance being Fe and inevitable impurities.

In addition, the present invention provides the ferritic stainless steel excellent in oxidation resistance having a chemical composition further containing one or more chemical elements selected from among, by mass %, B: 0.0030% or less, REM: 0.08% or less, Zr: 0.50% or less, V: 0.50% or less, Co: 0.50% or less and Ni: 0.50% or less.

Advantageous Effects of Invention

According to the present invention, the ferritic stainless steel excellent in 1000° C. oxidation resistance can be obtained, while preventing a deterioration in formability, without adding expensive chemical elements such as Mo or W. The steel according to the present invention can be ideally used for the parts of the exhaust system of an automobile.

BRIEF DESCRIPTION OF DRAWINGS

FIG. 1 is a graph illustrating the influence of the contents of Si and Al on oxidation resistance (a weight gain by oxidation).

DESCRIPTION OF EMBODIMENTS

The fundamental experiments which led to the completion of the present invention will be described. Hereinafter, % used when describing chemical composition always denotes mass %.

Steel having a basic chemical composition containing C: 0.006%, N: 0.007%, P: 0.03%, S: 0.003%, Mn: 0.2%, Cr: 15%, Nb: 0.49%, Cu: 0.5%, Ti: 0.005%, Mo: 0.01% and W: 0.01%, Si content was adjusted variously in the range of 0.1% or more and 1.5% or less and Al content was adjusted variously in the range of 0.02% or more and 1.5% or less was smelted by using an experimental method and made into a steel ingot of 50 kg. Then the steel ingot was subjected to hot rolling, hot rolled annealing, cold rolling and finishing annealing and made into a cold rolled and annealed steel sheet having a thickness of 2 mm. A test specimen of 30 mm×20 mm was cut out of the cold rolled steel sheet obtained as described above. Then a hole of 4 mmϕ was punched in the upper part of the test specimen. Then the surface and the edge face of the specimen was polished with a #320 emery paper. Then degreased and then used in an oxidation test described below.

<Continuous Oxidation Test in Air>

The test specimen described above was held in a furnace in air at a temperature of 1000° C. for a duration of 200 hours. Then a weight gain per unit area by oxidation ($g/m^2$) was derived from the measured difference in the mass of the test specimen before and after the heating test. Two specimens per each alloys were tested, and the case where there was a weight gain by oxidation of 50 $g/m^2$ or more was regarded as a case of breakaway oxidation, even one time was 50 $g/m^2$ or more.

FIG. 1 is a diagram illustrating the relationship between the contents of Si and Al and oxidation resistance. This FIGURE indicates that, in the case where the Si content is 0.4% or more and the Al content is 0.2% or more while the relationship is satisfied, breakaway oxidation does not occur, which means that an excellent oxidation resistance is achieved.

The present invention has been completed by conducting further investigations on the basis of the fundamental experiments described above.

The ferritic stainless steel according to the present invention will be described in detail hereafter.

The chemical composition according to the present invention will be described.

C: 0.015% or less

C is a chemical element which is effective for increasing the strength of steel, there is a significant deterioration in toughness and formability in the case where C content is more than 0.015%. Therefore, according to the present invention, the C content is set to be 0.015% or less. It is preferable that the C content be as small as possible from the viewpoint of achieving formability, the carbon content preferably be 0.008% or less. On the other hand, it is preferable that the C content be 0.001% or more in order to achieve a strength which is required to the parts of an exhaust system. More preferably C content is 0.002% or more and 0.008% or less.

Si: 0.40% or more and 1.0% or less and Al: 0.20% or more and 1.00% or less, while the relationship Si≥Al is satisfied Si and Al are both chemical elements which are important for improving oxidation resistance. As FIG. 1 indicates, it is necessary to satisfy the conditions Si: 0.40% or more, Al: 0.20% or more and Si≥Al at the same time in order to achieve excellent oxidation resistance at a temperature of 1000° C. However, in the case where the Si content is more than 1.00%, there is a deterioration in formability and a oxide scale spalling property. In addition, in the case where the Al content is more than 1.00%, there is a deterioration in formability and even oxidation resistance. Therefore, the Si content is set to be 0.40% or more and 1.00% or less and the Al content is set to be 0.20 mass % or more and 1.00 mass % or less while the relationship Si≥Al is satisfied. It is preferable that the Si content be 0.50% or more in the case where the oxidation resistance in a severer environment is required.

The mechanism through which oxidation resistance is improved in the ranges described above is not necessarily clear. It is considered to be as follows.

A dense continuous Si oxide layer is formed on the surface of a steel sheet in the case where the Si content is 0.40% or more and the oxide layer blocks a penetration of oxygen from an outside. Moreover, some oxygen which penetrates through the Si oxide layer into the inside of the steel sheet forms an oxide in combination with Al in the case where the Al content is 0.20% or more. Therefore, oxidation of Cr and Fe is suppressed, which results in an improvement in oxidation resistance. However, in the case where the relationship Si≥Al is not satisfied, since Al has a smaller standard free energy of formation of oxide, Al is preferentially combined with oxygen before Si combines with oxygen. Therefore the Si oxide layer cannot be sufficiently formed, which makes it impossible to prevent the diffusion of oxygen into the steel sheet. Therefore, breakaway oxidation tends to occur, because the oxidation of Al, Cr and Fe significantly proceeds.

Mn: 1.00% or less

Mn is a chemical element which causes an increase in the strength of steel. Mn is effective as a deoxidation agent, a γ phase tends to be formed at a high temperature in the case where Mn content is excessively large, which results in a deterioration in a heat resistance. Therefore, the Mn content is set to be 1.00% or less, preferably 0.70% or less. It is preferable that the Mn content be 0.05% or more in order to realize the effect of increasing strength and deoxidation.

P: 0.040% or less

P is a harmful chemical element which causes a deterioration in ductility, it is preferable that P content be as small as possible. Therefore, the P content is set to be 0.040% or less, preferably 0.030% or less.

S: 0.010% or less

S is a harmful chemical element which causes a deterioration in elongation and an r value, which has a negative influence on a formability. S causes a deterioration in corrosion resistance, which is the basic property of stainless steel, it is preferable that S content be as small as possible. Therefore, the S content is set to be 0.010% or less, preferably 0.005% or less.

Cr: 12.0% or more and 23.0% or less

Cr is a chemical element which is effective for improving corrosion resistance and oxidation resistance, which are characteristics of stainless steel. Sufficient oxidation resistance cannot be achieved in the case where Cr content is less than 12.0%. On the other hand, Cr is a chemical element which causes an increase in hardness and a deterioration in ductility due to solid solution strengthening of steel at room temperature. In particular, these negative influences become significant in the case where the Cr content is 23.0% or more.

Therefore, the Cr content is set to be 12.0% or more and 23.0% or less, preferably 14.0% or more and 20.0% or less.

N: 0.015% or less

N is a chemical element which causes a deterioration in the ductility and the formability of steel. These negative influences are significant in the case where N content is more than 0.015%. Therefore, the N content is set to be 0.015% or less. It is preferable that the N content be as small as possible from the viewpoint of achieving good ductility and formability and preferably N content be less than 0.010%.

Nb: 0.30% or more and 0.65% or less

Nb is a chemical element which is effective for improvement in corrosion resistance, formability and intergranular corrosion resistance at welded part by forming carbide, nitride and carbonitride in combination with C and N. Nb is effective for improvement in a thermal fatigue property by increasing high-temperature strength. These effects can be realized by setting Nb content to be 0.30% or more. On the other hand, a Laves phase ($Fe_2Nb$) tends to be precipitated in the case where the Nb content is more than 0.65%, which results in the acceleration of embrittlement. Therefore, the Nb content is set to be 0.30% or more and 0.65% or less, preferably 0.40% or more and 0.55% or less.

Mo: 0.10% or less

Mo is an expensive chemical element, additionally in view of the purpose of the present invention, Mo is not added positively. However, Mo may be mixed in from the raw material of steel such as scrap in the range of 0.10% or less. Therefore, the Mo content is confined to be 0.10% or less.

W: 0.10% or less

W is an expensive chemical element like Mo, additionally in view of the purpose of the present invention, W is not added positively. However, W may be mixed in from the raw material of steel such as scrap in the range of 0.10% or less. Therefore, the W content is confined to be 0.10% or less.

Cu: less than 1.00%

Cu is a chemical element which is very effective for improving a thermal fatigue property. Cu causes a significant deterioration in oxidation resistance and formability. This is caused by the precipitation of ϵ-Cu, and the precipitation of ϵ-Cu significantly occurs in the case where Cu content is 1.00% or more. On the other hand, since Cu is effective as a solid solution strengthening element. And since the driving force for precipitation of ϵ-Cu becomes small, Cu is not precipitated and is kept in the state of solid solution when the Cu content is less than 1.00%. Cu contributes to the strengthening of steel without a significant deterioration in formability and in oxidation resistance. It is preferable that the Cu content be 0.2% or more in order to realize this effect. Therefore, the Cu content is set to be less than 1.00%, preferably 0.30% or more and 0.80% or less, more preferably 0.30% or more and 0.70% or less.

Ti: 0.150% or less

Ti is effective for improving corrosion resistance, formability and intergranular corrosion resistance of a welded part by fixing C and N like as Nb does. However, this effect saturates and there is an increase in the hardness of steel in the case where Ti content is more than 0.150% in the present invention containing Nb. Therefore, the Ti content is set to be 0.150% or less. Since Ti has higher affinity for N than Nb does, Ti tends to form TiN of a large size. Since TiN of a large size tends to become an origin of a crack and causes a deterioration in toughness. It is preferable that the Ti content be 0.010% or less in the case where the toughness of a hot rolled steel sheet is necessary. Since it is not necessary to positively add Ti in the present invention, the lower limit of the Ti content includes 0%.

One or more chemical elements selected from among B, REM, Zr, V, Co and Ni may be further contained in the ferritic stainless steel according to the present invention in addition to the chemical composition described above.

B: 0.0030% or less

B is a chemical element which is effective for improving formability, in particular, secondary formability. However, in the case where B content is more than 0.0030%, B causes a deterioration in formability by forming BN. Therefore, in the case where B is contained, the B content is set to be 0.0030% or less. Since the effect described above is realized in the case where the B content is 0.0004% or more, it is preferable that the B content be 0.0004% or more and 0.0030% or less.

REM: 0.08% or less and Zr: 0.50% or less

REM (rare earth elements) and Zr are chemical elements which are effective for improving oxidation resistance and may be added as needed in the present invention. However, in the case where the content of REM (the sum of the contents of REM in the case where plural kinds of REM are contained) is more than 0.08%, there is the deterioration of the embrittlement of steel, and, in the case where Zr content is more than 0.50%, there is also the deterioration of the embrittlement of steel due to the precipitation of Zr intermetallic compound. Therefore, in the case where REM is contained, the content of REM is set to be 0.08% or less, and, in the case where Zr is contained, the Zr content is set to be 0.50% or less. Since the effect described above is realized in the case where the content of REM is 0.01% or more and in the case where the Zr content is 0.0050% or more. It is preferable that the content of REM be 0.01% or more and 0.08% or less and that the Zr content be 0.0050% or more and 0.50% or less.

V: 0.50% or less

V is a chemical element which is effective for improving formability and oxidation resistance. However, in the case where V content is more than 0.50%, V(C,N) of a large size is precipitated, which results in the deterioration of surface quality. Therefore, in the case where V is contained, the V content is set to be 0.50% or less. It is preferable that the V content be 0.15% or more and 0.50% or less in order to realize the effect of improving formability and oxidation resistance, more preferably 0.15% or more and 0.40% or less.

Co: 0.50% or less

Co is a chemical element which is effective for improving toughness. However, Co is an expensive chemical element and the effect of Co saturates in the case where Co content is more than 0.50%. Therefore, in the case where Co is contained, the Co content is set to be 0.50% or less. Since the effect described above is effectively realized in the case where the Co content is 0.02% or more. It is preferable that the Co content be 0.02% or more and 0.50% or less, more preferably 0.02% or more and 0.20% or less.

Ni: 0.50% or less

Ni is a chemical element which improves toughness. However, since Ni is expensive and a chemical element which strongly forms a γ phase. Ni causes a deterioration in oxidation resistance by forming a γ phase at a high temperature in the case where Ni content is more than 0.50%. Therefore, in the case where Ni is contained, the Ni content is set to be 0.50% or less. Since the effect described above is effectively realized in the case where the Ni content is 0.05% or more. It is preferable that the Ni content be 0.05 or more and 0.50 or less, more preferably 0.05% or more and 0.40% or less.

The remainder of the chemical composition consists of Fe and inevitable impurities. Among the inevitable impurities, it is preferable that O content be 0.010% or less, Sn content be 0.005% or less, Mg content be 0.005% or less and Ca content be 0.005% or less. More preferably the O content be 0.005 or less, the Sn content be 0.003% or less, the Mg content be 0.003% or less and the Ca content be 0.003% or less The method for manufacturing the ferritic stainless steel will be described hereafter. The stainless steel according to the present invention may be manufactured using a common method for manufacturing a ferritic stainless steel and there is no particular limitation on the manufacturing conditions. Examples of ideal manufacturing methods include smelting steel by using a well-known melting furnace such as a steel converter or an electric furnace. Further, optionally, making the steel have the chemical composition according to the present invention described above by performing secondary refining such as ladle refining or vacuum refining. Then making a slab of the steel by using a continuous casting method or an ingot casting-blooming rolling method. And then making the slab a cold rolled and annealed steel sheet through the processes such as hot rolling, hot rolled annealing, pickling, cold rolling, finishing annealing, pickling and so forth. The cold rolling described above may be performed one time or repeated two times or more with process annealing in between, and the processes of cold rolling, finishing annealing and pickling may be performed repeatedly. Moreover, optionally, hot rolled annealing may be omitted, and skin pass rolling may be performed after cold rolling or finishing annealing in the case where brightness of a steel sheet is required.

Examples of more preferable manufacturing conditions are as follows.

It is preferable that some of the conditions of a hot rolling process and a cold rolling process be specified. In a steel making process, it is preferable to smelt molten steel having the essential chemical composition described above and the optional chemical elements to be added as needed and to perform secondary refining by using a VOD method (Vacuum Oxygen Decarburization method). The smelted molten steel may be made into a steel material in a well-known method. It is preferable to use a continuous casting method from the viewpoint of productivity and material quality. The steel material obtained through a continuous casting process is heated up to a temperature of, for example, from 1000° C. or higher and 1250° C. or lower. And then made into a hot rolled steel sheet having a specified thickness. It is needless to say that the steel material may be made into a material of a shape other than a sheet. This hot rolled steel sheet is subjected to, as needed, batch annealing at a temperature of 600° C. or higher and 800° C. or lower or continuous annealing at a temperature of 900° C. or higher and 1100° C. or lower. And then it is made into a hot rolled sheet product after being descaled by performing pickling or the like. In addition, as needed, descaling may be performed by using a shot blasting method before pickling being performed.

In order to obtain a cold rolled steel sheet, the hot rolled and annealed steel sheet obtained as described above is made into a cold rolled steel sheet through a cold rolling process. In this cold rolling process, in accordance with manufacturing circumstances, cold rolling may be performed two times or more with process annealing in between as needed. The total rolling ratio of the cold rolling process, in which cold rolling is performed for one, two or more times, is set to be 60% or more, preferably 70% or more. The cold rolled steel sheet is subjected to continuous annealing (finishing annealing) at a temperature of 900° C. or higher and 1150° C. or lower, preferably 950° C. or higher and 1120° C. or lower, and pickling, and then made into a cold rolled and annealed steel sheet. In addition, in accordance with use application, the shape of and the material quality of the steel sheet may be adjusted by performing rolling with a light reduction ratio (such as skin pass rolling) after cold rolled annealing being performed.

The hot rolled sheet product or cold rolled and annealed sheet product obtained as described above are formed into the exhaust pipe of an automobile or a motor bicycle, a material to be used for a catalyst outer cylinder, the exhaust air duct of a thermal electric power plant, or a part related to a fuel cell (such as a separator, an inter connector or a reformer) by performing bending work or other kinds of work in accordance with use application. There is no limitation on welding methods for assembling these parts, and common arc welding methods such as MIG (Metal Inert Gas), MAG (Metal Active Gas) and TIG (Tungsten Inert Gas), resistance welding methods such as spot welding and seam welding, high-frequency resistance welding methods such as electric resistance welding and high-frequency induction welding methods may be applied.

EXAMPLES

Example 1

Each of the steel No. 1 through 18 having chemical compositions given in Table 1 was smelted by using a vacuum melting furnace and made into steel ingot of 50 kg. This ingot was heated up to a temperature of 1170° C., then subjected to hot rolling and made into a hot rolled steel sheet having a thickness 5 mm. Then it is subjected to hot rolled annealing at a temperature of 1040° C., and then pickling. This hot rolled steel sheet was subjected to cold rolling with a rolling ratio of 60%, finish annealing at a temperature of 1040° C., cooling at a cooling rate of 5° C./sec, pickling and then made into a cold rolled and annealed steel sheet having a thickness of 2 mm. Each of the steel No. 1 through 10 is an example in the range according to the present invention. And each of the steel No. 11 through 18 is a comparative example out of the range according to the present invention. Among the comparative examples, steel No. 11 has a chemical composition corresponding to SUS444, No. 12 has a chemical composition corresponding to Type429, and No. 16, No. 17 and No. 18 respectively have chemical compositions corresponding to example 3 of Patent Literature 2, example 3 of Patent Literature 3 and example 5 of Patent Literature 4. Cold rolled and annealed steel sheets No. 1 through 18 were used in an oxidation test as described below.

<Continuous Oxidation Test in Air>

A sample of 30 mm×20 mm was cut out of each of the cold rolled and annealed steel sheets obtained as described above. Then a hole of 4 mmϕ was punched in the upper part of the sample, then the surface and the edge face of the sample was polished with a #320 emery paper, then degreased. And then the sample was suspended in a furnace heated up to a temperature of 1000° C. in an atmospheric ambience for a holding time of 200 hours. After the test, the mass of the sample was measured, and then a weight gain by oxidation ($g/m^2$) was calculated by deriving the difference between the mass measured before and after the test. Two specimens per each alloys were tested, and oxidation resistance in air was evaluated by using the mean value of the difference in mass.

The results of the continuous oxidation test in air are additionally given in Table 1 as 1000° C. oxidation resistance. In the column of 1000° C. oxidation resistance, ○ denotes a case where breakaway oxidation did not occur, and x denotes a case where breakaway oxidation occurred. As Table 1 indicates, it is confirmed that any of the steel of the example of the present invention which is within the range of the present invention is, similarly to No. 11 which has a chemical composition corresponding to SUS444, excellent in 1000° C. oxidation resistance, because breakaway oxidation did not occur. In contrast, it is confirmed that any of the steel of the comparative example which is out of the range according to the present invention other than No. 11 is poor in 1000° C. oxidation resistance, because breakaway oxidation occurred. In the present invention, since Cu content is less than 1.00%, there is not a significant deterioration in formability. Mo content of No. 11 is 1.87% (being chemical composition corresponding to SUS444) is out of the range of the present invention.

INDUSTRIAL APPLICABILITY

The steel according to the present invention can be ideally used not only for the parts of an exhaust system of an automobile but also the parts of an exhaust system of a thermal electric power system and the parts of a solid-oxide fuel cell for which similar properties as that of the parts of an exhaust system of an automobile are required.

TABLE 1

Unit of Chemical Composition: mass %

| Sample No. | C | Si | Mn | Al | P | S | Cr | Cu | Nb | Ti | Mo | W | N | Others | Si—Al | 1000° C. Oxidation Resistance* | Note |
|---|---|---|---|---|---|---|---|---|---|---|---|---|---|---|---|---|---|
| 1 | 0.008 | 0.60 | 0.24 | 0.53 | 0.034 | 0.003 | 17.7 | 0.49 | 0.50 | 0.005 | — | — | 0.010 | — | 0.07 | ○ | Example |
| 2 | 0.008 | 0.43 | 0.19 | 0.38 | 0.032 | 0.003 | 21.9 | 0.39 | 0.47 | 0.006 | — | — | 0.009 | — | 0.05 | ○ | Example |
| 3 | 0.006 | 0.67 | 0.18 | 0.34 | 0.026 | 0.003 | 19.3 | 0.34 | 0.54 | 0.007 | — | — | 0.006 | — | 0.33 | ○ | Example |
| 4 | 0.006 | 0.58 | 0.25 | 0.42 | 0.024 | 0.004 | 14.7 | 0.46 | 0.51 | 0.009 | — | — | 0.008 | — | 0.16 | ○ | Example |
| 5 | 0.007 | 0.48 | 0.30 | 0.39 | 0.027 | 0.003 | 15.3 | 0.75 | 0.48 | 0.006 | — | — | 0.007 | — | 0.09 | ○ | Example |
| 6 | 0.007 | 0.77 | 0.32 | 0.72 | 0.027 | 0.002 | 12.6 | 0.61 | 0.41 | 0.008 | — | — | 0.008 | V: 0.22 | 0.05 | ○ | Example |
| 7 | 0.006 | 0.52 | 0.28 | 0.46 | 0.035 | 0.002 | 16.1 | 0.50 | 0.44 | 0.008 | — | — | 0.007 | B: 0.0015 | 0.06 | ○ | Example |
| 8 | 0.007 | 0.64 | 0.21 | 0.40 | 0.032 | 0.003 | 16.9 | 0.69 | 0.48 | 0.005 | — | — | 0.008 | Zr: 0.12 | 0.24 | ○ | Example |
| 9 | 0.007 | 0.72 | 0.33 | 0.49 | 0.029 | 0.002 | 18.2 | 0.25 | 0.52 | 0.007 | — | — | 0.009 | Co: 0.19 | 0.23 | ○ | Example |
| 10 | 0.008 | 0.45 | 0.26 | 0.28 | 0.033 | 0.003 | 14.0 | 0.82 | 0.43 | 0.007 | — | — | 0.007 | REM: 0.05 | 0.17 | ○ | Example |
| 11 | 0.007 | 0.31 | 0.42 | 0.02 | 0.031 | 0.003 | 18.7 | 0.02 | 0.52 | 0.005 | 1.87 | 0.02 | 0.008 | — | 0.29 | ○ | Comparative Example*1 |
| 12 | 0.007 | 0.82 | 0.27 | 0.01 | 0.026 | 0.003 | 14.4 | 0.03 | 0.45 | 0.005 | — | — | 0.008 | — | 0.81 | x | Comparative Example*2 |
| 13 | 0.007 | 0.79 | 0.21 | 0.06 | 0.028 | 0.003 | 17.6 | 0.41 | 0.43 | 0.009 | — | — | 0.008 | — | 0.73 | x | Comparative Example |
| 14 | 0.006 | 0.43 | 0.19 | 0.82 | 0.031 | 0.002 | 18.9 | 0.49 | 0.51 | 0.005 | — | — | 0.007 | — | −0.39 | x | Comparative Example |
| 15 | 0.005 | 0.55 | 0.25 | 0.34 | 0.029 | 0.004 | 20.3 | 1.67 | 0.52 | 0.008 | — | — | 0.007 | — | 0.21 | x | Comparative Example |
| 16 | 0.008 | 0.32 | 0.05 | 0.01 | 0.028 | 0.002 | 17.0 | 1.93 | 0.33 | 0.010 | 0.01 | 0.02 | 0.010 | Ni: 0.10<br>V: 0.10 | 0.31 | x | Comparative Example*3 |
| 17 | 0.009 | 0.46 | 0.54 | 0.01 | 0.029 | 0.003 | 18.9 | 1.36 | 0.35 | 0.080 | 0.01 | 0.02 | 0.007 | Ni: 0.10<br>V: 0.03<br>B: 0.0030 | 0.46 | x | Comparative Example*4 |
| 18 | 0.006 | 0.22 | 0.05 | 0.05 | 0.005 | 0.005 | 18.8 | 1.65 | 0.42 | 0.090 | 0.02 | 0.02 | 0.006 | Ni: 0.15 | 0.17 | x | Comparative Example*5 |

Underline indicates the value out of the range according to the present invention.

*1000° C. Oxidation Resistance: x with Breakaway Oxidation ○ without Breakaway Oxidation

*1SUS444

*2Type429

*3Example 3 of Patent literature 2

*4Example 3 of Patent literature 3

*5Example 5 of Patent literature 4

The invention claimed is:

1. A ferritic stainless steel having a chemical composition containing, by mass %, C: 0.015% or less, Si: 0.40% or more and 1.00% or less, Mn: 1.00% or less, P: 0.040% or less, S: 0.010% or less, Cr: 15.3% or more and 23.0% or less, N: 0.015% or less, Nb: 0.30% or more and 0.65% or less, Ti: 0.150% or less, Mo: 0.10% or less, W: 0.10% or less, Cu: less than 1.00%, Al: 0.20% or more and 1.00% or less, while the relationship mass % of Si mass % of Al is satisfied, and the balance being Fe and inevitable impurities.

2. The ferritic stainless steel of claim 1, further containing one or more chemical elements selected from the group consisting of, by mass %, B: 0.0030% or less, REM: 0.08% or less, Zr: 0.50% or less, V: 0.50% or less, Co: 0.50% or less and Ni: 0.50% or less.

3. The ferritic stainless steel of claim 1, wherein the mass % of Si is greater than the mass % of Al by at least 0.05%.

4. The ferritic stainless steel of claim 1, wherein the mass % of Si is greater than the mass % of Al by at least 0.17%.

5. The ferritic stainless steel of claim 1, wherein the mass % of Si is from 0.43% or more and 1.00% or less.

6. The ferritic stainless steel of claim 1, wherein the mass % of Al is from 0.28% or more and 1.00% or less.

* * * * *